US009080340B2

(12) United States Patent
Timischl

(10) Patent No.: US 9,080,340 B2
(45) Date of Patent: Jul. 14, 2015

(54) DEVICE FOR MOVING COVERINGS FOR INSULATING POOLS

(75) Inventor: Karl Timischl, Gerasdorf (AT)

(73) Assignee: Harald Jursitzky, Mittendorf an der Fischa (AT)

( * ) Notice: Subject to any disclaimer, the term of this patent is extended or adjusted under 35 U.S.C. 154(b) by 15 days.

(21) Appl. No.: 14/009,864

(22) PCT Filed: Apr. 6, 2012

(86) PCT No.: PCT/AT2012/000097

§ 371 (c)(1),
(2), (4) Date: Oct. 4, 2013

(87) PCT Pub. No.: WO2012/135886

PCT Pub. Date: Oct. 11, 2012

(65) Prior Publication Data

US 2014/0020170 A1 Jan. 23, 2014

(30) Foreign Application Priority Data

Apr. 6, 2011 (AT) ..... A 486/2011

(51) Int. Cl.
*E04H 4/00* (2006.01)
*E04H 4/08* (2006.01)

(52) U.S. Cl.
CPC ..... *E04H 4/084* (2013.01)

(58) Field of Classification Search
CPC ..... E04H 4/084
USPC ..... 4/488–513
See application file for complete search history.

(56) References Cited

FOREIGN PATENT DOCUMENTS

| | | | |
|---|---|---|---|
| AT | 4 379 | U1 | 6/2001 |
| DE | 10 2008 032158 | A1 | 2/2009 |
| FR | 2 9130 41 | A1 | 8/2008 |
| WO | 2009/129756 | A2 | 10/2009 |

OTHER PUBLICATIONS

International Preliminary Report on Patentability dated Oct. 8, 2013 for Application No. PCT/2012/000097.

*Primary Examiner* — Lori Baker
(74) *Attorney, Agent, or Firm* — Ladas & Parry LLP

(57) ABSTRACT

A device for moving coverings for insulating pools, which covering is composed of two parts connected to each other in an articulated manner, which parts of the covering lie flat on an upper edge of the pool in a closed state. In order to enable a comfortable motorized movement of such a covering into a preferably horizontal position behind the pool and back again without modifying the pool itself, the rear part of the covering is connected to the pool by a hinge, and the front part of the covering is connected to two lifting arms which are arranged at the sides of the pool and which are driven by at least one drive, such that when the lifting arms rotate, the covering is able to be transferred from the closed state to an open state in which the covering lies behind the pool and back again by a lifting/folding motion.

7 Claims, 4 Drawing Sheets

DEVICE FOR MOVING COVERINGS FOR INSULATING POOLS

RELATED APPLICATION INFORMATION

This application is a 371 of International Application PCT/AT2012/000097 filed 06 Apr. 2012 entitled "Device For Moving Coverings For Insulating Pools", which was published on 11 Oct. 2012, with International Publication Number WO 2012/135886 A1, and which claims priority from Austria Patent Application A 486/2011 filed 06 Apr. 2011, the content of which is incorporated herein by reference.

The invention relates to a device for moving coverings for insulating pools, which covering is composed of two parts connected to each other in an articulated manner, which parts of the covering lie flat on an upper edge of the pool in a closed state.

Such a device and/or a cover lifter serves for lifting coverings or so-called thermocovers, as are used nowadays in modern whirlpools, spas, hot tubs, etc.

Hitherto in the prior art were structures which permitted such a commercially available covering to be lifted from the pool and/or to be moved into a vertical position behind the pool. The covering then rests positioned behind or above the edge of the pool. In this case, before being opened, the covering has to be manually released from the pool and, after being closed, said covering has to be refixed. This generally takes place via straps mounted on the covering. Insulated coverings generally consist of two styropor cores welded in nylon, which are inserted into chambers of a vinyl sleeve which is resistant to UV light. Said chambers are connected in the centre by a reinforced vinyl web and thus form a hinge extending over the entire width of the pool. Said coverings insulate the pool thermally relative to the surroundings and thus prevent heat loss of the heated pool water. Said coverings also provide protection from environmental influences on the water.

DE 10 2008 032 158 A1 discloses a whirlpool covering according to the prior art which consists of two or more parts connected together in an articulated manner. The parts of the covering may be pivoted and moved via a gear mechanism. The device for folding the covering is of relatively complex construction. Moreover, in the open state of the whirlpool, parts of the folded covering protrude over the upper edge thereof in an unsatisfactory manner.

WO 2009/129756 A2 discloses a two-part covering of a whirlpool, one part being moved into a substantially vertical position for opening the covering. The part articulated to said part slides on rollers along the upper edge of the pool and in the open state of the whirlpool is located substantially parallel to the first part of the covering. By a corresponding mechanism, the folded-up covering is able to be lowered into a storage space provided therefor adjacent to the whirlpool. In addition to the complexity of the construction, it is also a drawback that the storage space for the folded-up covering generally has to be configured to be deeper than the pool, whereby additional structural measures are required. Moreover, alterations have to be made to the whirlpool, permitting or facilitating the rolling of the covering part on the edge of the pool.

Finally, U.S. Pat. No. 6,000,072 A discloses a covering for whirlpools consisting of two parts connected together in an articulated manner, one part having to be moved manually onto the other part before the two superimposed parts of the covering are manually pivoted via lateral lifting arms and a horizontal bar adjacent to the edge of the pool. In this case, in addition to the manual actuation, the parts of the folded-up covering protruding over the edge of the pool are also troublesome in the open state of the whirlpool.

The technical object of the invention is the comfortable, automatic movement of such a commercially available two-part whirlpool covering (the whirlpool or the spa is denoted hereinafter as the pool) into a position behind the pool during the uncovering process and back again during the covering process.

The object is achieved according to the invention by the rear part of the covering being connected to the pool by means of a hinge, and the front part of the covering being connected to two lifting arms which are arranged at the sides of the pool and which are driven by at least one drive, such that when the lifting arms rotate, the covering is able to be transferred from the closed state to an open state in which the covering lies behind the pool and back again by a lifting/folding motion. The covering lies folded-up in the uncovered state and invisible to the bather(s) behind the pool, which opens up completely new perspectives for the builder of the pool deck, the landscape designer, etc., and the entire covering could even be concealed in a cabinet which in turn could be designed as a reclining surface. In this case, the pool itself is not modified in any respect. By means of the structure described here and the drives, the bearing points and the pivot points thereof, the covering describes a complex lifting/folding motion which represents the entire uncovering and/or covering process. When the pool is open, the covering is not located vertically in the space as in previous solutions, but lies folded-up to half its width behind the pool and does not interfere with the bather(s) in any respect. In the closed state, further fixing of the covering to the pool, for example via corner straps is no longer necessary.

Advantageously, in the open state, the parts of the covering lie folded-up horizontally behind the pool below the upper edge of the pool.

If the at least one drive of the lifting arms is designed to be self-locking, the parts of the covering are held fixedly in position. A further fixing of the covering to the pool against the effects of wind and other influences is no longer necessary.

A sliding rail may be provided on the side of each lifting arm facing the pool, in which sliding rail a pin fixedly connected to the front part of the covering is able to be mounted in a rotatable and linear displaceable manner.

An adjustable stop is preferably arranged in the sliding rail of each lifting arm for limiting the displacement path of the pin.

Each lifting arm may be of angular configuration, as an angled lifting arm. As a result, the lifting/folding motion is assisted and the corresponding position of the folded-up covering in the open state of the pool is permitted and/or assisted.

The sliding rail may be formed from polyamide (PA) or polyacetol.

The invention is described in more detail with reference to an exemplary embodiment according to the following drawings, in which.

Figure 1:
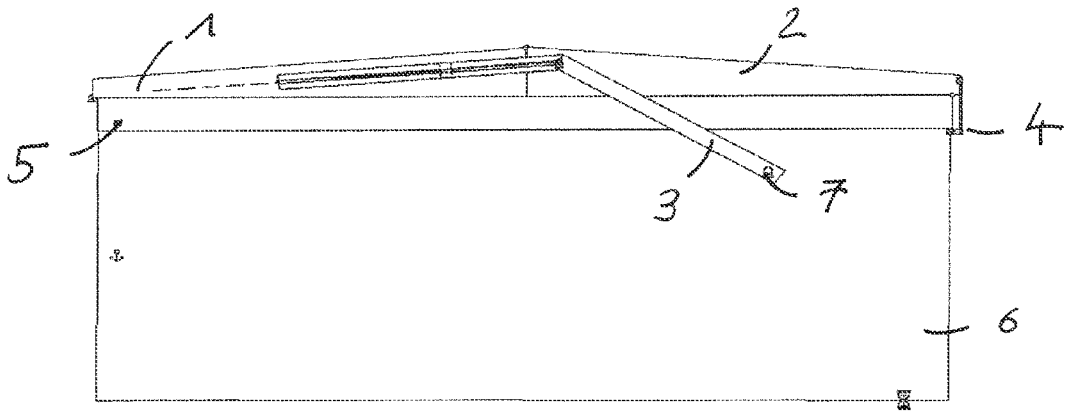
FIG. 1 shows a side view of a pool with a two-part covering in the closed state.
Figure 2:
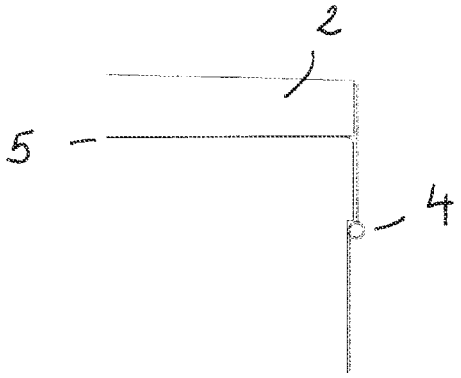
FIG. 2 shows a detailed view of the hinge for the articulated connection of one part of the covering to the pool.

FIG. 1 shows a side view of a pool 6 with a covering in the closed state consisting of two parts 1, 2 connected to each other in an articulated manner. The rear part 2 of the covering is connected to the pool 6 by means of a hinge 4 (see FIG. 2). In this case, the upper leaf of the rear hinge 4 is fixedly connected to the rear part 2 of the covering. The pivot point of the hinge 4 in this case is located in a defined position below the upper edge 5 of the pool 6. The front part 1 of the covering connected in an articulated manner to the rear part 2 is connected to lifting arms 3, which may be rotated by at least one drive 7. The components of the cover lifter, such as the lifting arms 3, hinge 4, etc. are preferably designed symmetrically on both sides of the pool 6. The front part 1 of the covering is held fixedly in position by the self-locking of the at least one drive 7, and the rear part 2 of the covering is held fixedly in position by the hinge 4. A further fixing of the covering to the pool 6 against the effects of wind and other influences is no longer necessary.

The sequence of opening or uncovering and/or closing or covering, as might be viewed from one side of the pool 6, is described hereinafter. When opening and closing, in the case of two drives 7, said drives run synchronously from one end position to the other. The end position is defined, on the one hand, as the closed or covered state of the covering where the two parts 1 and 2 of the covering lie flat on the upper edge 5 of the pool and, on the other hand, the open or uncovered state where the parts 1 and 2 of the covering lie folded-up horizontally on top of one another behind the pool 6.

Figure 3:
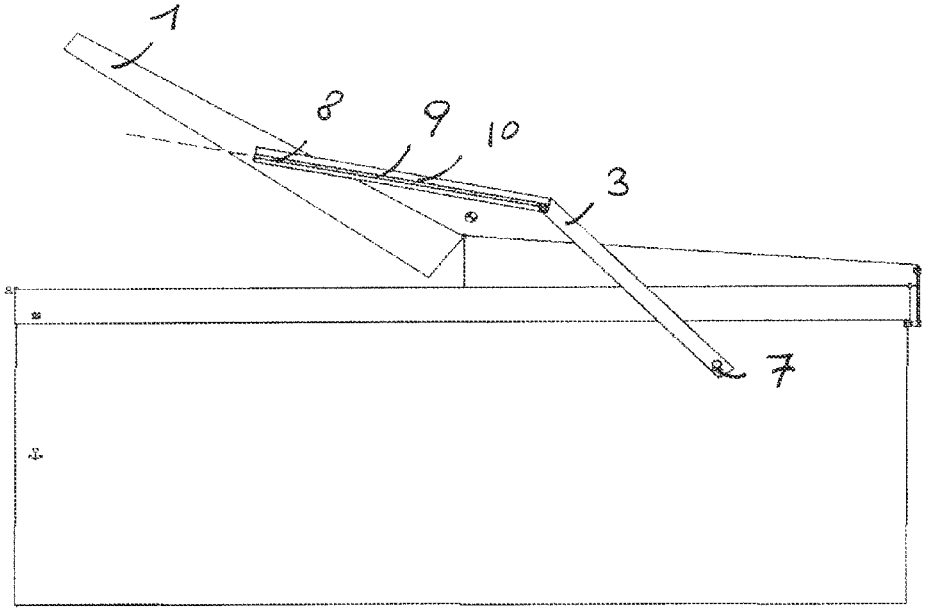
FIG. 3 shows a side view of the pool according to FIG. 1 with the covering slightly open.

FIG. 3 shows the initial uncovering process. The drive 7 rotates the lifting arm 3 clockwise and thus lifts the front part 1 of the covering. A sliding rail 9 inserted in the front region of the lifting arm 3 or integrated therein, supports a pin 8 in a rotatable and linear displaceable manner in the lifting arm 3. Said pin 8 is connected fixedly to the front part 1 of the covering and limited in its path by a stop 10 on the sliding rail 9 (see also FIG. 4 and FIG. 5). This construction permits the front part 1 of the covering to perform both a rotational motion about the axis of the pin 8 and a linear motion along the guide in the sliding rail 9, also limited by the stop 10 and/or the end of the sliding rail 9.

Figure 4:
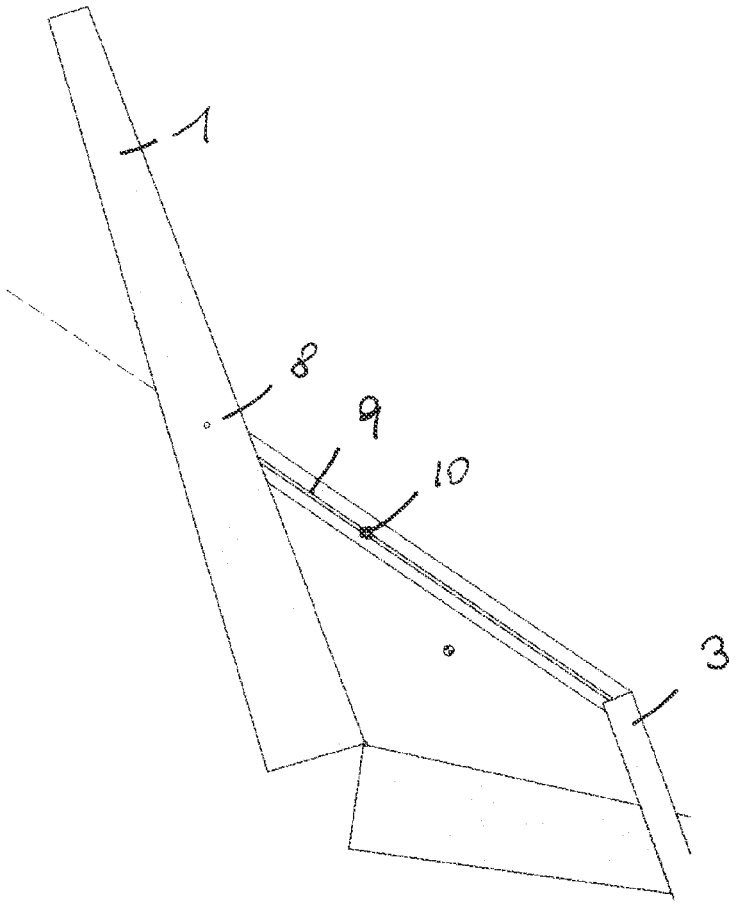
FIG. 4 shows a detailed view of the partially open covering in the region of the lifting arm.

FIG. 4 shows a detail of the front part 1 of the covering with the lifting arm 3. A mechanical stop 10 limits the path of the pin 8 on its path in the sliding rail 9.

Figure 5:
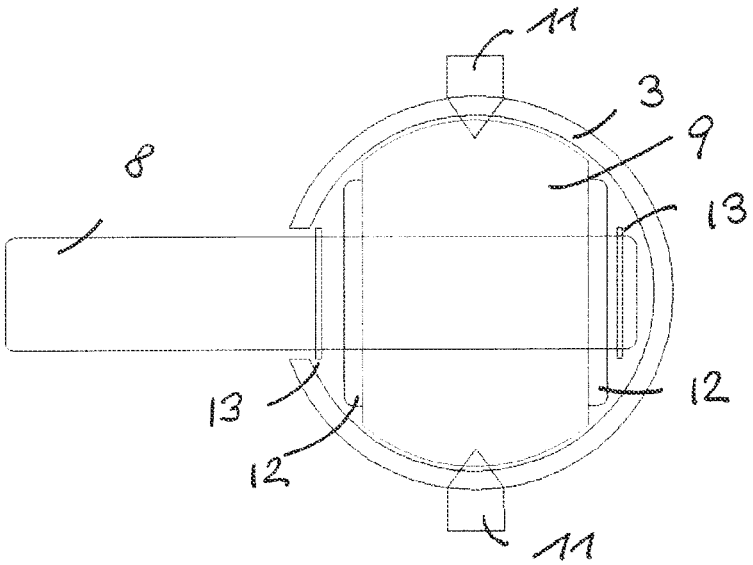
FIG. 5 shows a section through an embodiment of a lifting arm.

FIG. 5 shows the cross section of an embodiment of the front lifting arm 3 in detail. The round stainless steel tube of the lifting arm 3 is slotted on the side facing the pool 6, and thus permits the pin 8 a free linear motion along the stainless steel tube over a specific length. The path of the pin 8 is thus limited at the front by the end of the sliding rail 9, and at the rear by the adjustable stop 10 which is fixedly connected to the sliding rail 9. Said sliding rail 9 manufactured from polyamide (PA) or polyacetol is inserted from the front into the hollow lifting arm 3 and fixed at the top and bottom by screws 11. The pin 8 formed from alloy steel which in turn is fixed by washers 12 and circlips 13 on both sides of the sliding rail 9, permits the front part 1 of the covering to move along the sliding rail 9, which serves as a guide, with a maintenance-free rotational and sliding motion.

Figure 6:
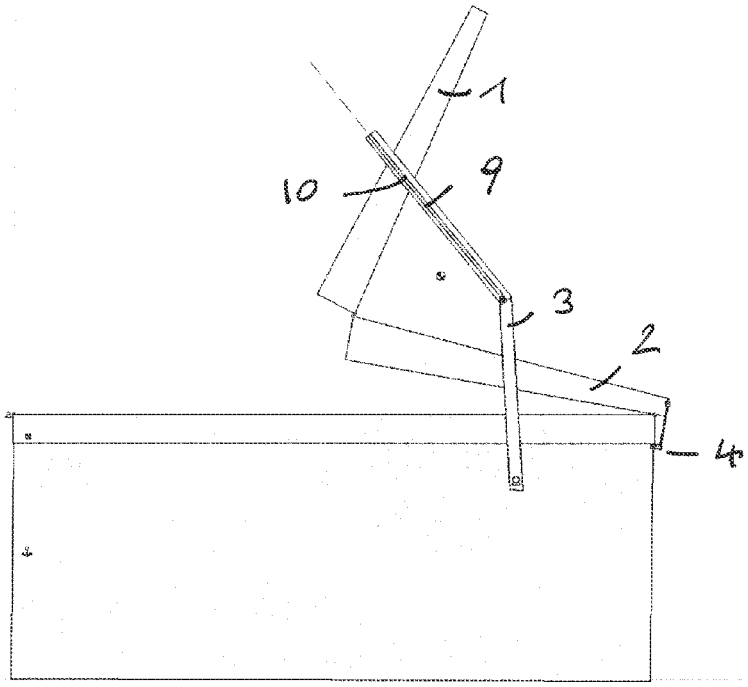
FIG. 6 shows a side view of the pool according to FIG. 1, with the covering half open.

FIG. 6 shows the opening process of the covering in a subsequent state. The rotational movement of the lifting arm 3 is continued, the front part of the covering has reached its rear stop 10 in the sliding guide 9 by the force of gravity and now the second part 2 of the covering which still lies flat begins an upwardly oriented rotational movement about the bearing point in the hinge 4.

Figure 7:
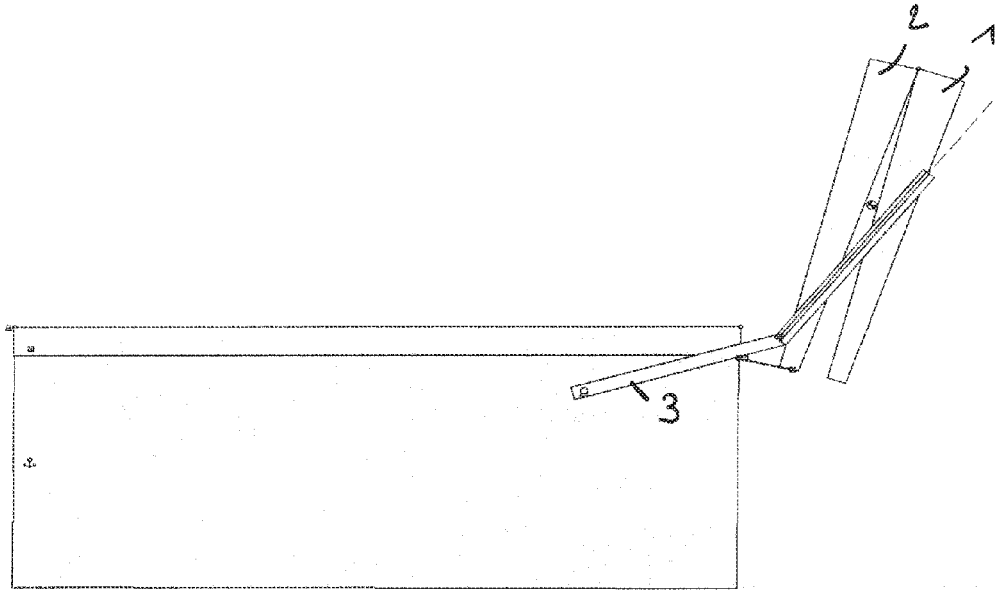
FIG. 7 shows a side view of the pool according to FIG. 1 with the covering almost completely open.

FIG. 7 shows the folding process of the covering behind the pool 6. The rotational movement of the lifting arm 3 is continued, the front part 1 of the covering is placed on the rear part 2 of the covering and subsequently the folded-up covering moves as a unit into a horizontal position.

Figure 8:
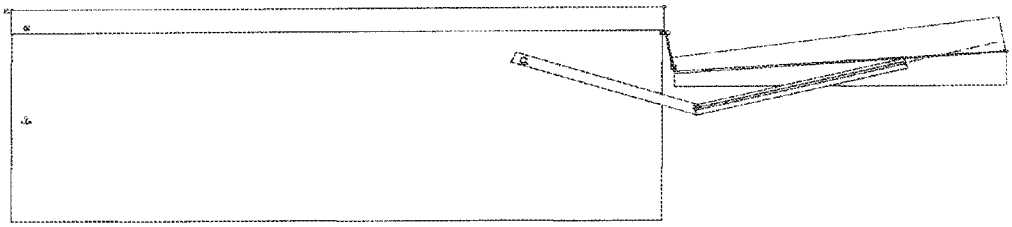
FIG. 8 shows a side view of the pool according to FIG. 1 with the covering completely open.
Figure 9:
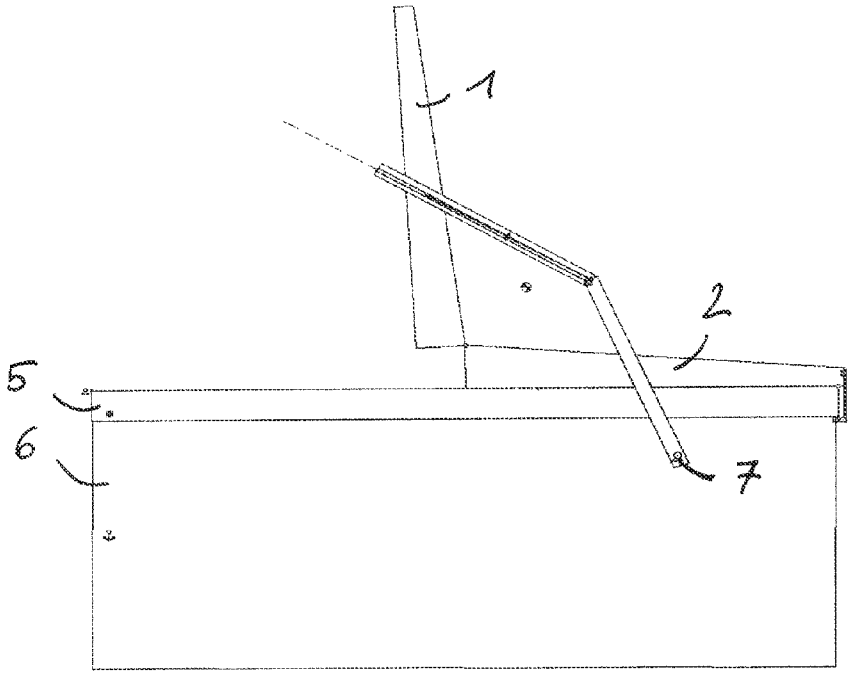
FIG. 9 shows a side view of the pool according to FIG. 1 with the covering half closed.

FIG. 8 shows the covering in the completely open state. The covering process is carried out in reverse sequence. The entire covering is lifted in an upwardly oriented rotational movement, the rear part 2 of the covering is initially placed on the upper edge 5 of the pool 6, at this time the front part 1 of the covering has already moved past the vertical (see FIG. 9) and follows the curved path via the pin 8 slidably mounted in the sliding rail 9, downwards to the front until both parts 1 and 2 of the covering come to rest flat on the upper edge 5 of the pool 6 (see FIG. 1).

The invention claimed is:

1. A system for providing a moveable insulating covering to a pool which comprises:

A covering having forward and rear parts said covering being moveable between a first position in which it covers the pool wherein said parts of the covering lie flat on an upper edge of the pool so as to cover the pool and a second position in which the covering lies behind the pool leaving the pool is uncovered, and A cover-moving device to move the covering between said first and second positions Wherein the rear part of said covering is connected to the pool by a hinge and the forward part of the covering is connected to the rear part of the covering in an articulated manner, and Wherein the cover-moving device comprises two lifting arms which arms are arranged at the sides of the pool and which are driven by at least one drive operably connected to the lifting arms to cause them to rotate Said front part of the covering being connected to said lifting arms such that when the lifting arms rotate to remove the cover, the covering is transferred from the first position to the second position by lifting the rear and forward parts of the covering and folding the front and rear part parts of the covering together and when said lifting arms rotate to replace the cover on the pool, the lifting arms unfold the two parts of the cover and lower it on to the pool.

2. System according to claim 1, wherein said pool has an upper edge and in said second position the front and rear parts of the covering lie folded-up horizontally behind the pool below the upper edge of the pool.

3. System according to claim 1 wherein at least one drive of the lifting arms is designed to be self-locking.

4. System according to claim 1, wherein a sliding rail is provided on the side of each lifting arm facing the pool, in which sliding rail a pin fixedly connected to the front part of the covering is able to be mounted in a rotatable and linear displaceable manner.

5. System according to claim 4, wherein an adjustable stop is arranged in the sliding rail of each lifting arm for limiting the displacement path of the pin.

6. System according to claim 1, wherein each lifting arm contains a bend.

7. System according to claim 4, wherein the sliding rail is formed from polyamide or polyacetol.

* * * * *